US010857649B2

(12) United States Patent
Lee et al.

(10) Patent No.: US 10,857,649 B2
(45) Date of Patent: Dec. 8, 2020

(54) METHOD AND APPARATUS FOR PERFORMING A POLISHING PROCESS IN SEMICONDUCTOR FABRICATION

(75) Inventors: Bo-I Lee, Sindian (TW); Huang Soon Kang, Hsin Chu (TW); Chi-Ming Yang, Hsin-Chu (TW); Chin-Hsiang Lin, Hsin-Chu (TW)

(73) Assignee: TAIWAN SEMICONDUCTOR MANUFACTURING COMPANY, LTD., Hsin-Chu (TW)

( * ) Notice: Subject to any disclaimer, the term of this patent is extended or adjusted under 35 U.S.C. 154(b) by 1833 days.

(21) Appl. No.: 13/240,856

(22) Filed: Sep. 22, 2011

(65) Prior Publication Data

US 2013/0078810 A1 Mar. 28, 2013

(51) Int. Cl.
*B24B 37/32* (2012.01)
*B24B 9/06* (2006.01)

(52) U.S. Cl.
CPC ..... *B24B 37/32* (2013.01); *B24B 9/065* (2013.01)

(58) Field of Classification Search
CPC ..... B24B 37/32; B24B 9/065
USPC ..... 438/692
See application file for complete search history.

(56) References Cited

U.S. PATENT DOCUMENTS 4,183,535 A * 1/1980 Goldfarb ..... A63F 7/3622 273/120 R
5,861,066 A * 1/1999 Moinpour ..... B08B 1/04 134/6
5,916,412 A * 6/1999 Nakashiba ..... B24B 37/32 156/345.14
6,019,868 A * 2/2000 Kimura ..... B24B 37/32 156/345.14
6,077,385 A * 6/2000 Kimura ..... B24B 37/30 156/345.14
6,113,467 A * 9/2000 Koike ..... B24B 37/08 257/E21.23
6,168,684 B1 * 1/2001 Mitsuhashi ..... B24B 37/32 156/345.14
6,309,981 B1 * 10/2001 Mayer ..... C23F 1/08 156/345.21
6,558,232 B1 * 5/2003 Kajiwara ..... B24B 37/30 451/288
6,910,240 B1 * 6/2005 Boyd ..... B08B 1/04 15/102
7,052,374 B1 * 5/2006 Lu ..... B24B 57/02 451/60
7,115,023 B1 * 10/2006 Owczarz ..... B24B 9/065 451/303

(Continued)

*Primary Examiner* — Keath T Chen
(74) *Attorney, Agent, or Firm* — Haynes and Boone, LLP

(57) ABSTRACT

The present disclosure provides an apparatus for fabricating a semiconductor device. The apparatus includes a polishing head that is operable to perform a polishing process to a wafer. The apparatus includes a retaining ring that is rotatably coupled to the polishing head. The retaining ring is operable to secure the wafer to be polished. The apparatus includes a soft material component located within the retaining ring. The soft material component is softer than silicon. The soft material component is operable to grind a bevel region of the wafer during the polishing process. The apparatus includes a spray nozzle that is rotatably coupled to the polishing head. The spray nozzle is operable to dispense a cleaning solution to the bevel region of the wafer during the polishing process.

18 Claims, 10 Drawing Sheets

(56) References Cited

U.S. PATENT DOCUMENTS

| | | | | |
|---|---|---|---|---|
| 2001/0029150 | A1* | 10/2001 | Kimura | B24B 9/065 451/41 |
| 2003/0022495 | A1* | 1/2003 | Netsu | B24B 37/345 438/689 |
| 2003/0116444 | A1* | 6/2003 | Basol | C25F 3/14 205/668 |
| 2009/0239446 | A1* | 9/2009 | Fukuda | B24B 37/005 451/5 |
| 2011/0159783 | A1* | 6/2011 | Fukushima | B24B 37/042 451/11 |

* cited by examiner

METHOD AND APPARATUS FOR PERFORMING A POLISHING PROCESS IN SEMICONDUCTOR FABRICATION

BACKGROUND

The semiconductor integrated circuit (IC) industry has experienced rapid growth. Technological advances in IC materials and design have produced generations of ICs where each generation has smaller and more complex circuits than the previous generation. However, these advances have increased the complexity of processing and manufacturing ICs and, for these advances to be realized, similar developments in IC processing and manufacturing are needed. In the course of integrated circuit evolution, functional density (i.e., the number of interconnected devices per chip area) has generally increased while geometry size (i.e., the smallest component (or line) that can be created using a fabrication process) has decreased.

To fabricate these semiconductor devices, a plurality of semiconductor fabrication processes are performed. One of these processes is a chemical-mechanical-polishing (CMP) process, which is performed to polish a surface of a wafer. However, conventional CMP processes may have wafer scratch issues, which can lead to wafer acceptance test failure or low wafer yields.

Therefore, while existing CMP processes have been generally adequate for their intended purposes, they have not been entirely satisfactory in every aspect.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
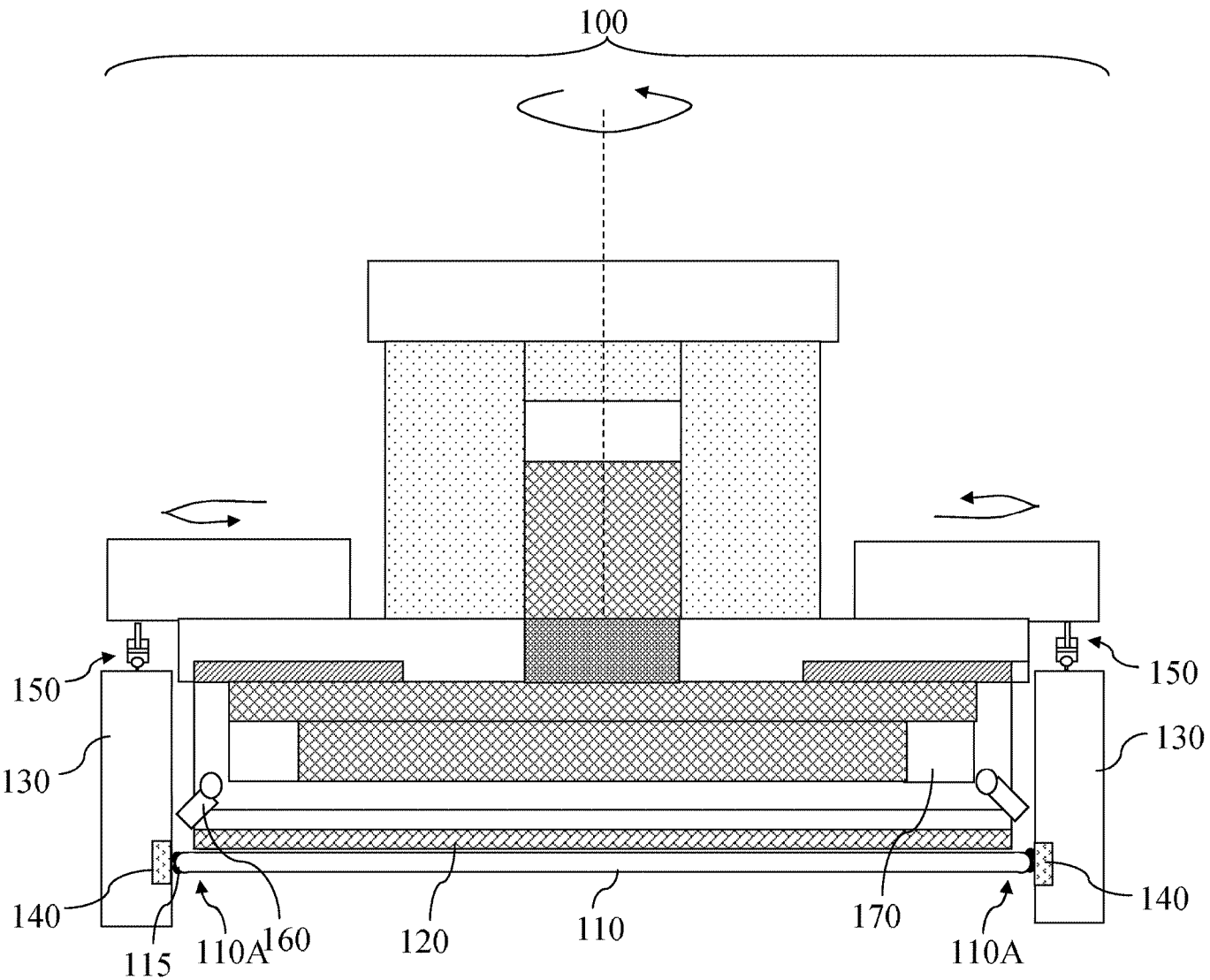
FIG. 1 is a simplified diagrammatic view of a wafer polishing head according to various aspects of the present disclosure.

It is understood that the following disclosure provides many different embodiments, or examples, for implementing different features of various embodiments. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

During semiconductor fabrication, polishing processes such as chemical-mechanical-polishing (CMP) processes may be performed to polish and planarize the surface of a wafer. However, residue particles may be collected on the wafer from previous processes, for example from prior lithography or deposition processes. These particles may be difficult to remove, particularly if the particles are collected on a bevel region of a wafer (i.e., on the side of the wafer). This is at least in part due to the fact that the bevel regions of the wafer are less accessible and more difficult to rinse than the top and bottom surfaces of the wafer. Stated differently, a rinsing solution may be dispensed on the wafer's surface to wash away the particles or residue on the surface, but the same rinsing solution may not be able to reach the bevel regions effectively. Thus, the rinsing solution may not be able to efficiently and adequately wash away the particles or residue deposited on the bevel regions of the wafer. During the CMP process, these particles may come into contact with a polishing pad of a CMP polishing head and result in scratches of the wafer surface. The scratches on the wafer lead to wafer failures or reduced yields.

According to various aspects of the present disclosure, an improved method and apparatus of performing a wafer polishing process that substantially reduces the wafer scratches is discussed below. FIG. 1 is a simplified diagrammatic fragmentary cross-sectional view of a CMP polishing head 100. A wafer 110 is placed under the polishing head. In an embodiment, the wafer 110 is a silicon substrate doped with either a P-type dopant such as boron (e.g., P-type substrate) or an N-type dopant such as phosphorous (e.g., N-type substrate). In other embodiments, the wafer 110 may include other elementary semiconductors such as germanium and diamond. In further embodiments, the wafer 110 may optionally include a compound semiconductor and/or an alloy semiconductor. Further, the wafer 110 may include an epitaxial layer (epi layer), may be strained for performance enhancement, and may include a silicon-on-insulator (SOI) structure. The wafer 110 may also include electronic circuitry formed by semiconductor devices. These semiconductor devices may include transistors, resistors, capacitors, inductors, etc.

The wafer 110 has bevel regions 110A, which include portions of the wafer 110 located on its sides. Residue or particles 115 are formed on the bevel regions 110A of the wafer 110 from prior fabrication processes. The residue or particles 115 may also be referred to as bevel defects 115. In the following paragraphs, a method and an apparatus of removing the bevel defects 115 (so as to avoid wafer scratching during polishing) are described in more detail.

The CMP polishing head includes a membrane 120 that is located above the wafer 110. The membrane 120 may include a flexible or pliable material, for example synthetic rubber. In an embodiment, the membrane 120 is pressed against the wafer 110 and makes contact with the wafer surface during polishing. The use of the membrane 120 during a wafer polishing process may reduce distortion of the wafer 110.

The CMP polishing head includes a retaining ring 130 (also referred to as a retainer ring). The wafer 110 is secured by the retaining ring 130 during the polishing process. The retaining ring 130 includes a material composition that is relatively hard, for example polyphenylene sulfide or polycarbonate with a stainless steel ring encapsulated therein. The hardness of the retaining ring 130 may cause problems if the retaining ring 130 were to make direct contact with the bevel region 110A of the wafer 110. For example, if the retaining ring 130 comes into physical contact with the bevel regions 110A of the wafer 110 while the bevel region is being polished, the wafer 110 may experience cracking. In addition, the bevel defects 110A would have been stuck between the retaining ring 130 and the bevel region 110A of the wafer 110 and as a result would have been inconvenient to remove. These are some of the problems facing conventional CMP polishing heads.

To address these shortcomings of conventional CMP polishing heads, the retaining ring 130 of the CMP polishing head 100 in FIG. 1 includes an embedded soft material component 140. The soft material component 140 has a material composition that is softer than the wafer. In an embodiment, the soft material component 140 is softer than silicon. For example, the soft material component 140 may include a sponge material. In some embodiments, the soft material component 140 has a hardness that is lower than wafer. The soft material 140 comes into direct physical contact with the bevel defects 115. The softness of the soft material component 140 allows the bevel defects 115 to be scrubbed off the wafer 110 without causing the wafer 110 to crack.

The retaining ring 130 is coupled to the rest of the CMP polishing head 100 through a rotationally flexible mechanism, for example cylinders 150. The cylinders 150 include a trackball therein, which is coupled to the retaining ring 130 and allows the retaining ring 130 to be rotated 360 degrees. The cylinders 150 also can move up and down to adjust the position of the retaining ring 130. The flexibility of the positional and rotational movements of the retaining ring 130 (enabled by the cylinders 150) allows the retaining ring 130 to be used to polish the bevel regions 110A of the wafer 110, so as to remove the bevel defects 115.

The CMP polishing head 100 also includes one or more spray nozzles 160. The spray nozzles 150 are positioned adjacent to the bevel regions 110A of the wafer 110. During a polishing process, the spray nozzles 160 are operable to dispense a cleaning solution, such as de-ionized water (DIW) or chemicals, to clean the bevel region 110A and rinse off the bevel defects 115.

The CMP polishing head 100 also includes an inner tube 170 which is a sensor component for pressure detection.

Figure 2A:
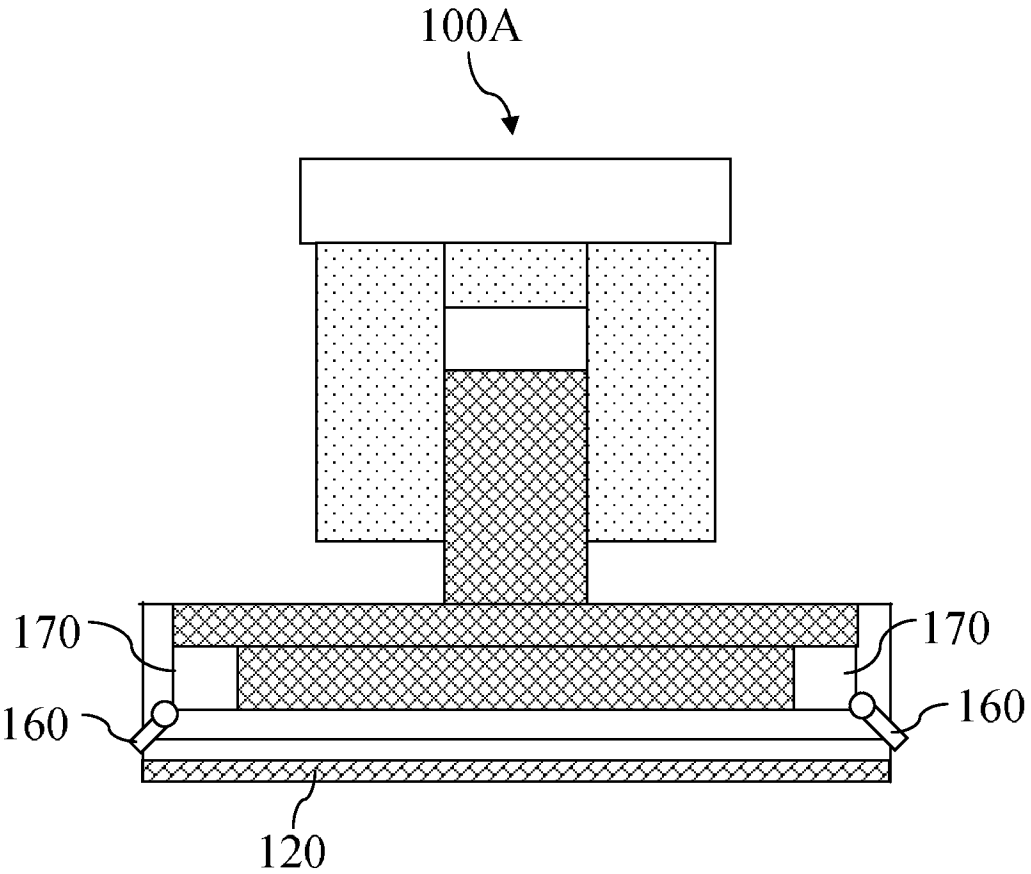
FIGS. 2A-2C are diagrammatic views of various components of the wafer polishing head of FIG. 1 according to various aspects of the present disclosure.
Figure 2B:
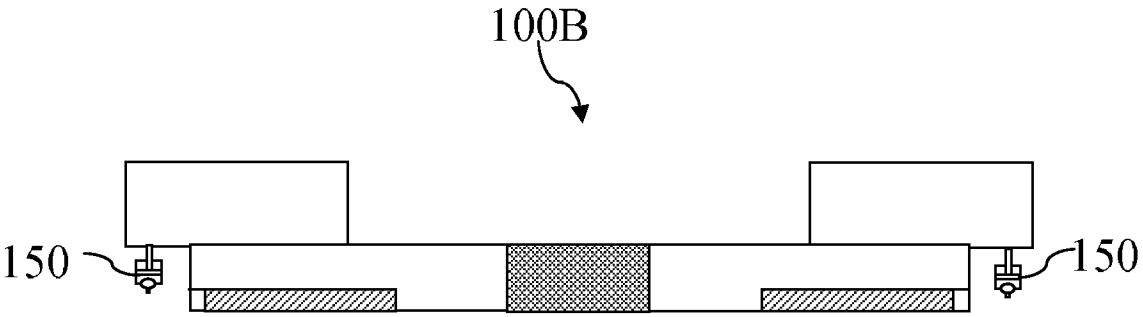
Figure 2C:
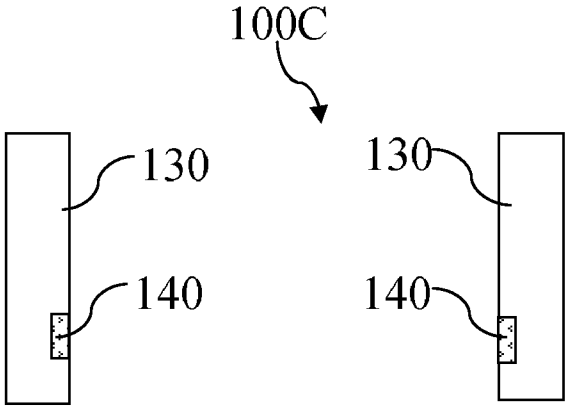

FIGS. 2A-2C are exploded cross-sectional views of various components of the CMP polishing head 100 of FIG. 1. FIG. 2A shows a component 100A of the CMP polishing head 100. Among other things, the component 100A includes the membrane 120, the spray nozzles 160, and the inner tube 170. FIG. 2B shows a component 100B of the CMP polishing head 100. Among other things, the component 100B includes the cylinders 150. FIG. 2C shows a component 100C of the CMP polishing head 100. The component 100C includes the retaining ring 130, which includes the soft material component 140.

During the polishing process, a pressure may be delivered to the wafer 110 through the component 100A, and the CMP polishing head components 100A, 100B, and 100C can be combined together to perform a rotational movement of the polishing head. The polishing head may move across an upper (or lower) surface of the wafer 110 (FIG. 1) to planarize the wafer surface. Meanwhile, the CMP polishing head components 100B and 100C can be combined to perform a rotational movement of the retainer ring 130, which may be performed independently of the rotation of the polishing head. In other words, the retaining ring 130 (specifically, the soft material component 140) can be rotated to polish the bevel regions 110A of the wafer 110 simultaneously as the polishing head is moved to polish the surface of the wafer 110.

Figure 3:
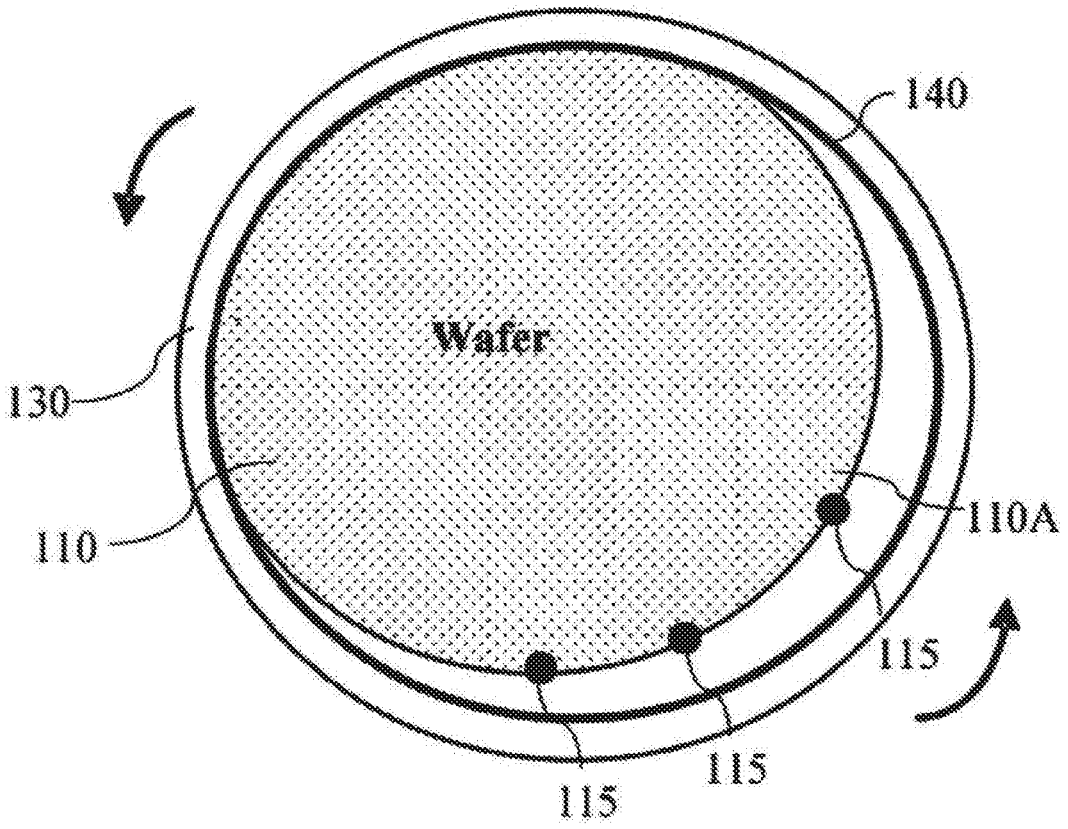
FIG. 3 is a diagrammatic top view of a wafer and a retaining structure that is a part of the wafer polishing head of FIG. 1 according to various aspects of the present disclosure.

The process of polishing the bevel regions 110A of the wafer is illustrated in FIG. 3, which shows diagrammatic top views of the retaining ring 130 and the wafer 110. As shown in FIG. 3, the wafer 110 is positioned inside the retraining ring 130, which contains an embedded soft material component 140. Bevel defects 115 reside on the edges or the bevel regions 110A of the wafer 110. As the upper surface of the wafer 110 is polished during the polishing process, the retaining ring 130 is being rotated as well. The rotation of the retaining ring 130 causes the soft material component 140 of the retaining ring 130 to come into physical contact with the bevel defects 115 and grind the defects loose.

While the bevel defects 115 are being loosened, the spray nozzles 160 (not illustrated in FIG. 3) dispense a cleaning solution such as DIW or chemicals toward the bevel regions 110A to wash away the bevel defects 115. It is understood that the spray nozzles 160 may also dispense the solution after the polishing process is over in some embodiments. As discussed above, the soft material component 140 of the retaining ring 110 allows the bevel defects 115 to be removed without cracking the wafer. In addition, the implementation of the spray nozzles 160 to wash away the bevel defects 115 simplifies the bevel defects removal process, since existing CMP polishing heads may require a separate cleaning polishing head to dispense a cleaning solution to wash away the bevel defects. In comparison, the integration of the spray nozzles 160 within the CMP polishing head 100 herein helps save cost and reduces fabrication process time.

Figure 4:
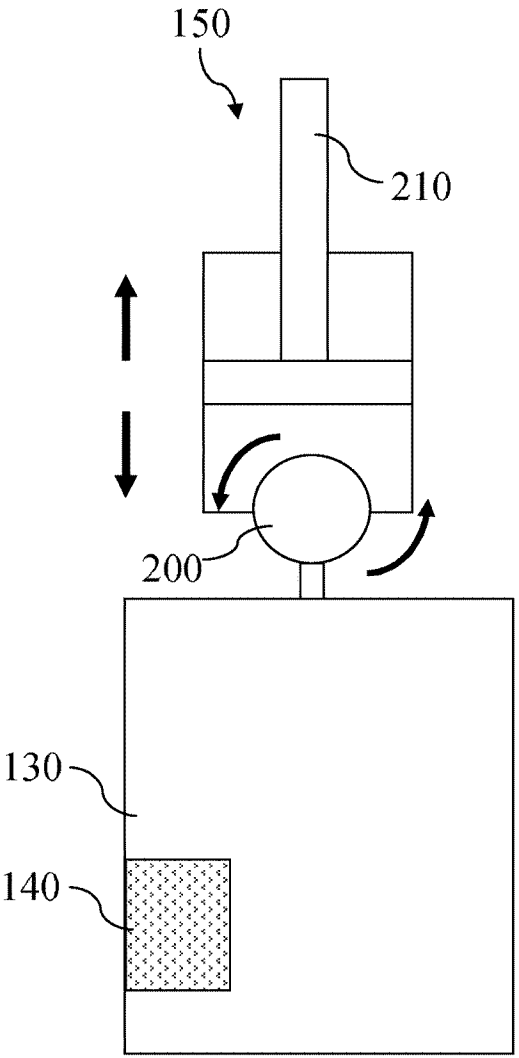
FIG. 4 is a diagrammatic view of a retaining structure and a coupling mechanism according to various aspects of the present disclosure.

FIG. 4 is a more detailed diagrammatic cross-sectional view of the cylinder 150 and the retaining ring 130 discussed above according to an embodiment of the present disclosure. The retaining ring 130 (containing the embedded soft material component 140) is coupled to the cylinder 150 through a rotatable mechanism 200. The rotatable mechanism 200 is capable of rotating 360 degrees in all directions. In the embodiment illustrated herein, the rotatable mechanism 200 includes a trackball. In alternative embodiments, other suitable devices may be used to implement the rotatable mechanism 200.

The rotational flexibility of the rotatable mechanism 200 allows the retaining ring 130 to be rotated dynamically in a desired manner, for example rotated 360 degrees around the bevel regions 110A of the wafer 110 (FIGS. 1 and 3). It is understood that the spray nozzles 160 may each be coupled to the component 100A of the CMP polishing head through a similar rotatable mechanism such as a trackball. As such, the positioning and the spray angle of the spray nozzles 160 may be flexibly adjusted by way of the trackballs.

The cylinder 150 also includes a rod 210, through which the cylinder 150 is coupled to the CMP polishing head component 100A. In an embodiment, the rod 210 is retractable, which allows the cylinder 150 (and therefore the retaining ring 130) to be moved vertically up and down. For example, the retaining ring 130 may be moved up once the wafer bevel polishing process is completed.

Figure 5B:
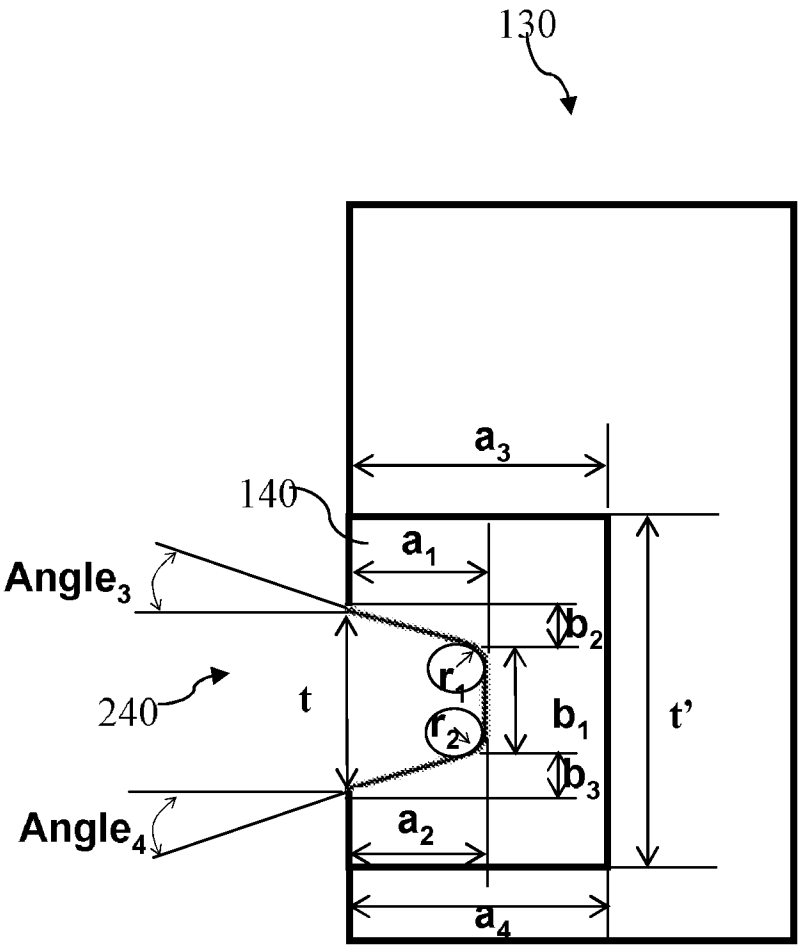
FIGS. 5A and 5B are diagrammatic geometrical and dimensional views of a bevel region of a wafer and a portion of a retaining structure according to various aspects of the present disclosure.
Figure 5A:
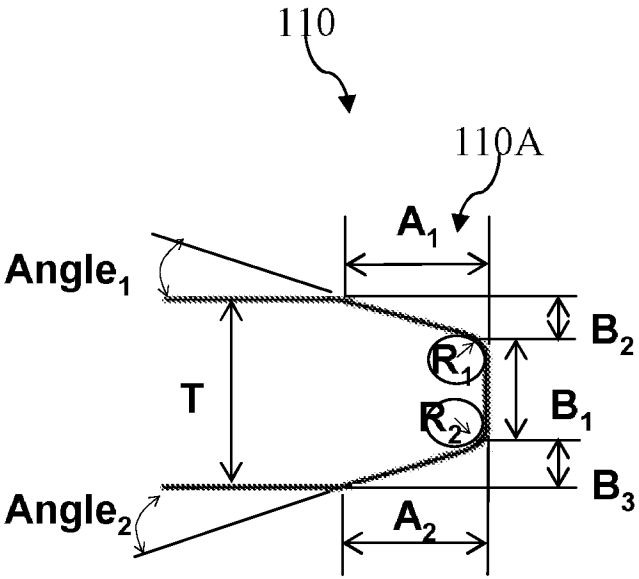

FIGS. 5A and 5B are diagrammatic fragmentary cross-sectional dimensional views of the portion of the wafer 110 and the retaining ring 130 containing the soft material component 140, respectively. In more detail, FIG. 5A illustrates the geometrical and dimensional conditions for the bevel region 110A of the wafer 110 according to an embodiment, and FIG. 5B illustrates the geometrical and dimensional requirements for the embedded soft material component 140 according to an embodiment.

Referring to FIG. 5A, the bevel region 110A is an angular (or curved) end portion of the wafer 110. The curvature (which may be measured by an angle) of the angular end portion is designated in FIG. 5A as $R_1$ and $R_2$. The angular end portion has sloped upper and lower surfaces that form angles $Angle_1$ and $Angle_2$ with the top and bottom surfaces of the wafer 110, respectively. These sloped upper and lower surfaces of the angular end portions have lateral dimensions (widths) $A_1$ and $A_2$, respectively, as well as vertical dimensions (heights) $B_2$ and $B_3$, respectively. The side surface of the angular end portion has a vertical dimension $B_1$. The wafer 110 has a thickness (vertical dimension) T. In the illustrated embodiment, T is substantially equal to a sum of $B_1$, $B_2$, and $B_3$.

Referring to FIG. 5B, the soft material component 140 has an angular recess 240, which is configured to house the bevel region 110A of the wafer 110. The angular recess 240 has curvatures, which are designated in FIG. 5B as $r_1$ and $r_2$. The angular recess 240 has sloped upper and lower surfaces that form angles $Angle_3$ and $Angle_3$ with a line parallel to the top and bottom surfaces of the wafer 110, respectively. These sloped upper and lower surfaces of the angular recess 240 have lateral dimensions (widths) $a_1$ and $a_2$, respectively, as well as vertical dimensions (heights) $b_2$ and $b_3$, respectively. The side surface of the angular recess 240 has a vertical dimension $b_1$. The angular recess 240 has a vertical dimension t, which is substantially equal to a sum of $b_1$, $b_2$, and $b_3$ in the illustrated embodiment. The embedded soft material component 140 has a vertical dimension t'. The soft material component 140 also has a horizontal dimension $a_3$ for its top side, and a horizontal $a_4$ for its bottom side.

In an embodiment, the following geometrical and dimensional conditions are true:

$t'>t>T$ $a_1, a_2>A_1, A_2$ $a_3, a_4>a_1, a_2$ $b_1>B_1$ $b_2, b_3>B_2, B_3$ $r_1, r_2>R_1, R_2$ $Angle_3, Angle_4>Angle_1, Angle_2$ These geometrical and dimensional conditions listed above help ensure that the bevel region 110A of the wafer 110 can be adequately and efficiently accommodated within the recess 240 of the soft material component 140 of the retaining ring 130. In addition, these geometrical and dimensional conditions listed above also help ensure that the optimal amount of physical contact is created between the bevel region 110A and the soft material component 140. In this manner, the bevel region 110A (and the defects formed thereon) can be efficiently loosened and washed away during the bevel polishing and spray nozzle rinsing processes described above.

Figure 6:
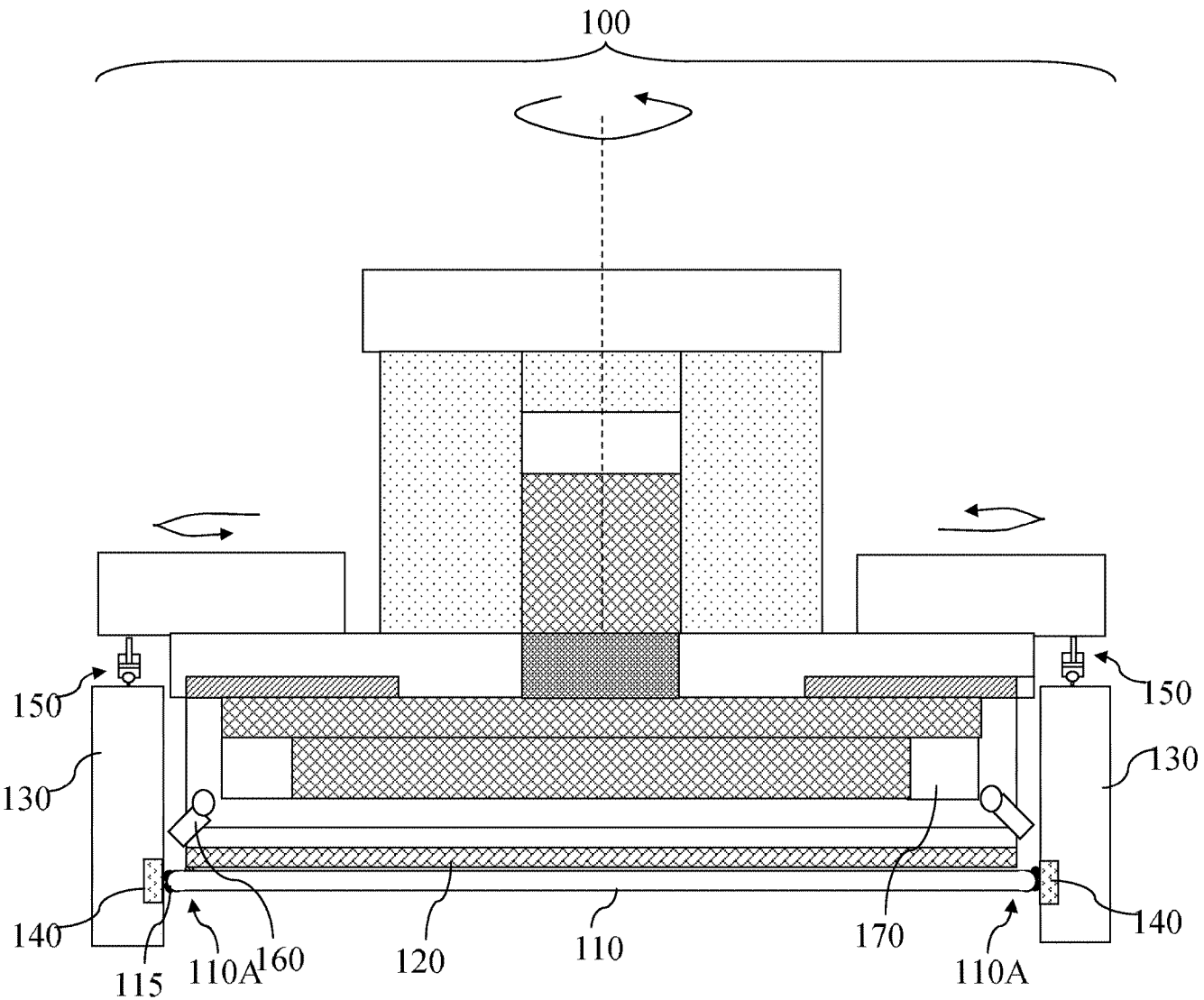
FIGS. 6-8 are diagrammatic views of the wafer polishing head at various stages of fabrication according to various aspects of the present disclosure.
Figure 7:
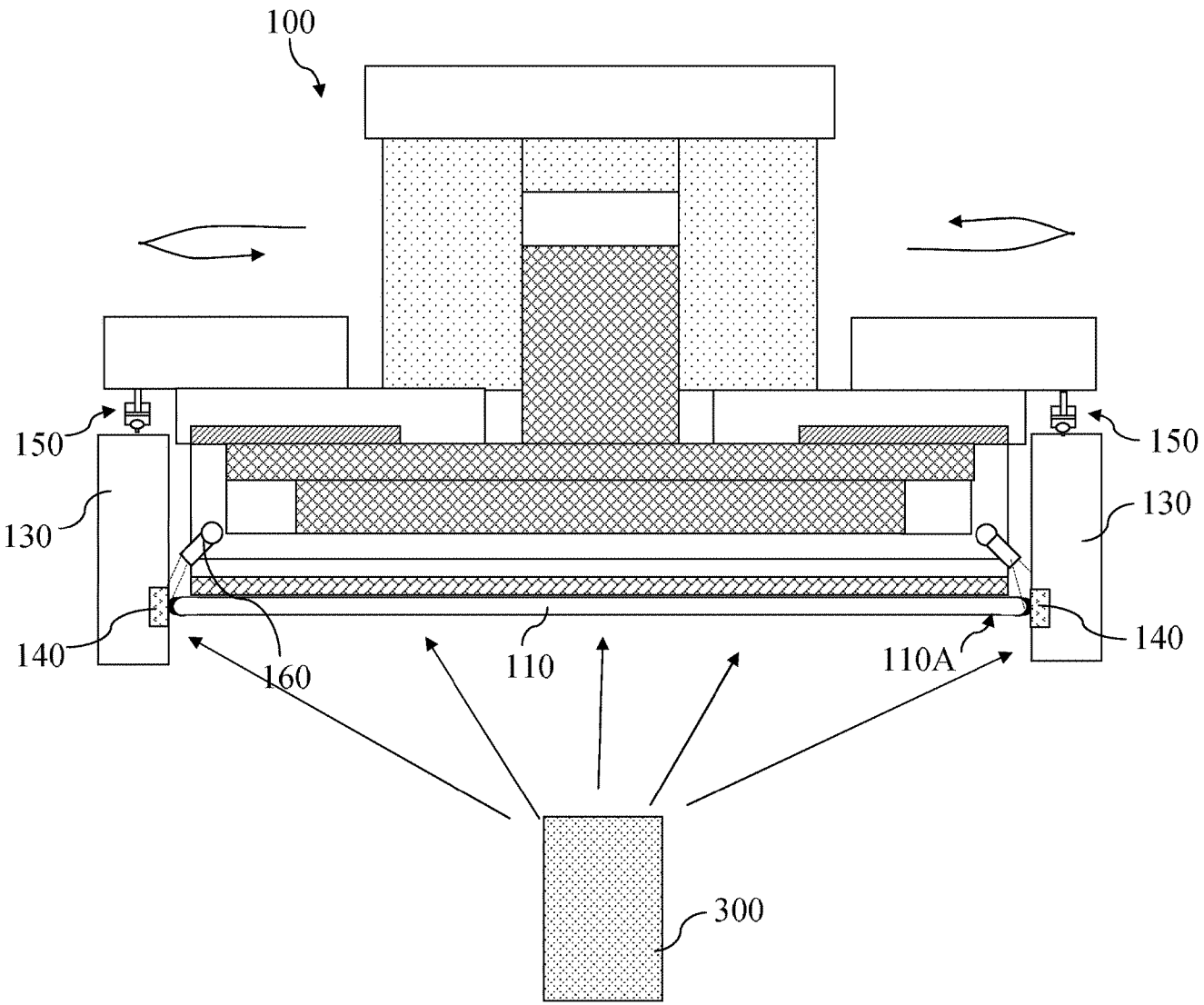
Figure 8:
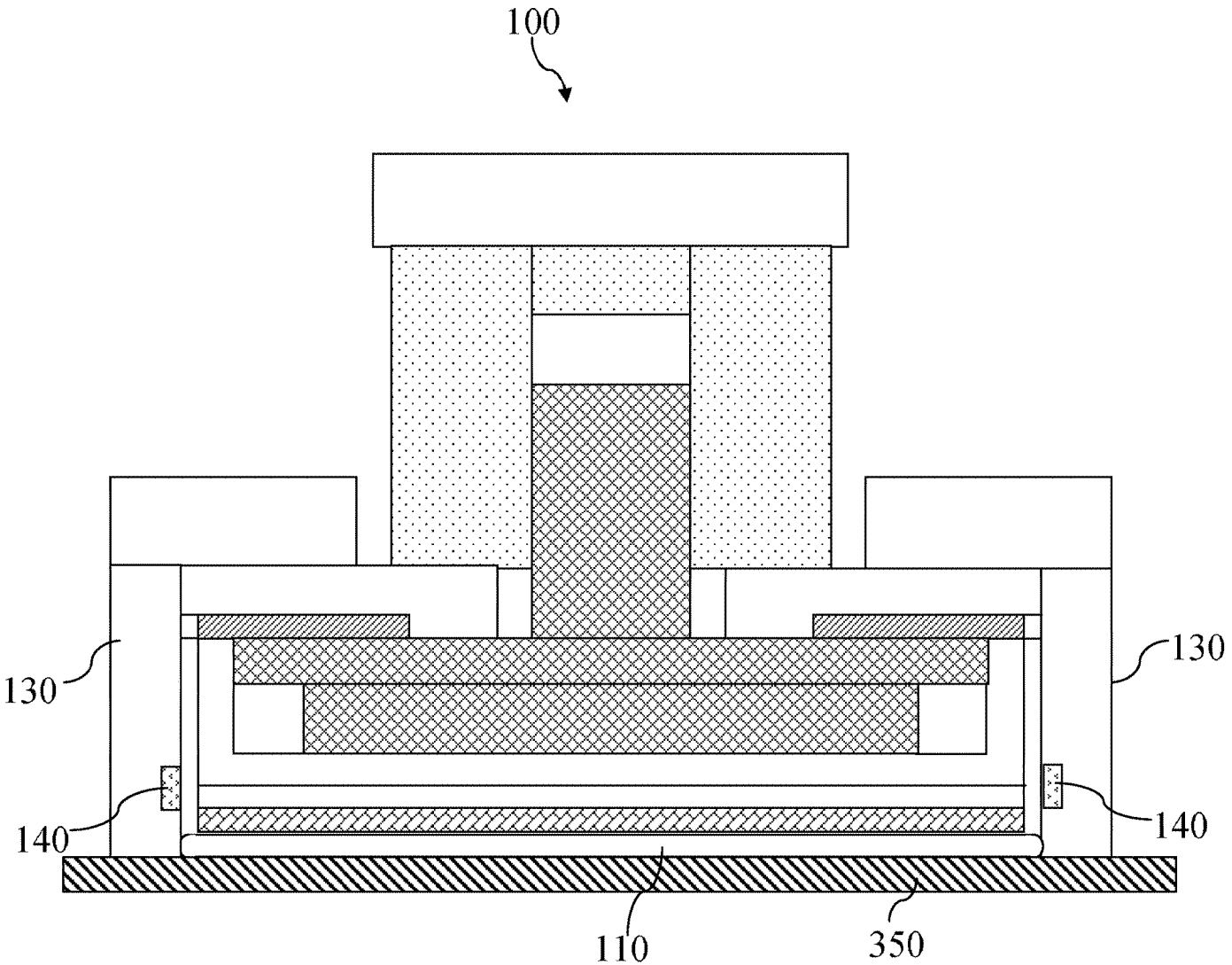

FIGS. 6-8 are simplified diagrammatic cross-sectional views of the CMP polishing head 100 at various stages of a polishing process. Referring to FIG. 6, the bevel regions 110A of the wafer 110 are polished by the CMP polishing head 100 in a wafer bevel polishing stage of the fabrication. The wafer 110 is secured by the retaining ring 130. The bevel regions 110A of the wafer 110 make physical contact with the soft material components 140 embedded within the retaining ring 130. As discussed above, the retaining ring 130 is operable to rotate 360 degrees around the wafer 110. In this manner, the bevel defects 115 are loosened from the bevel regions 110A.

Referring to FIG. 7, in a rinsing stage of the fabrication, the spray nozzles 160 spray a cleaning solution, for example DIW or chemicals, to the bevel regions 110A of the wafer 110. Since the bevel defects 115 have already been loosened by the rotation of the retaining ring 130 from the previous fabrication stage shown in FIG. 6, the spraying of the cleaning solution helps rinse the bevel defects 115 away from the wafer 110. It is also understood that since the spray nozzles 160 are rotationally flexible, they may be configured to spray the cleaning solution onto the front surface of the wafer 110 as well, thereby removing any defects residing on the front surface of the wafer 110. The integration of the spray nozzles 160 within the CMP polishing head 100 (as opposed to a separate processing polishing head) helps simplify the fabrication process and reduce fabrication costs, since both wafer polishing and cleaning can now be done simultaneously in one fabrication stage using a single fabrication polishing head.

During this stage, an inter platen 300 positioned underneath the wafer 110 may be operable to dispense a cleaning solution to the bottom surface or the back side of the wafer 110. The inter platen 300 may be equipped with rotationally flexible spray nozzles similar to the spray nozzles 160. The cleaning solution may be dispensed from these nozzles to wash the back side of the wafer 110 and remove defects disposed thereon.

Referring to FIG. 8, in a wafer surface polishing stage of the fabrication, the retaining ring 130 is moved up (for example through the retractable rod 210 of FIG. 4). The backside of the wafer 110 is pressed up against a polishing pad 350. The polishing pad has a hard and smooth surface. The CMP polishing head 100 rotates the wafer 110 and moves it laterally with respect to the polishing pad 350. In this manner, the back side of the wafer 110 may be planarized by the polishing pad. It is understood that the front side or the top surface of the wafer 110 may be planarized the same way (by flipping the wafer 110 over). Since the bevel defects have already been effectively removed in the prior processes, it is unlikely that defect particles will get stuck between the polishing pad and the wafer surface. Therefore, wafer scratching is substantially eliminated.

Figure 9:
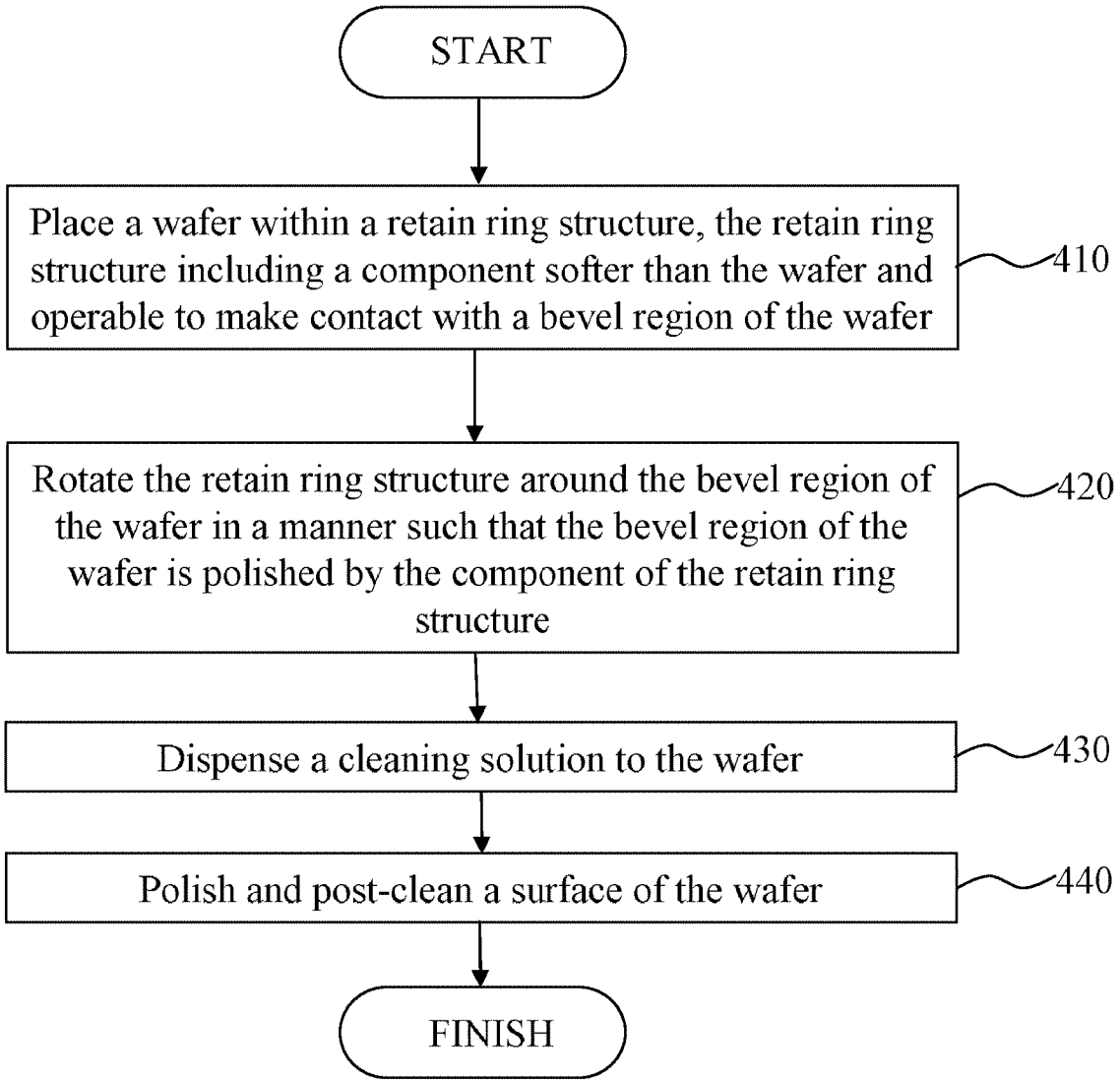
FIG. 9 is a flow chart illustrating a method of performing a wafer polishing process according to various aspects of the present disclosure.

FIG. 9 is a flowchart illustrating a method 400 of performing a polishing process according to various aspects of the present disclosure. It is understood, however, that additional processes may be performed before, during, or after the method 400 of FIG. 9, but these processes are not discussed herein for the sake of simplicity. The method 400 includes block 410, in which a wafer is placed within a retaining ring structure. The retaining ring structure includes a component that is softer than the wafer and that is operable to make contact with a bevel region of the wafer. The method 400 includes block 420, in which the retaining ring structure is rotated around the bevel region of the wafer in a manner such that the bevel region of the wafer is polished by the component of the retaining structure. The method 400 includes block 430, in which a cleaning solution is dispensed to the wafer. The method 400 includes block 440, in which a surface of the wafer is polished and post-cleaned.

The CMP polishing head disclosed according to the various aspects of the present disclosure offer advantages over conventional CMP polishing heads, it being understood that other embodiments of the CMP polishing head may offer different advantages, and that no particular advantage is required for all embodiments. One of the advantages is offered by the soft material component embedded in the retaining ring. The soft material component can be used to grind the bevel region of a wafer. The softness of the embedded component reduces the likelihood of wafer cracking during the wafer bevel polishing process, thereby improving wafer yield.

Another advantage is offered by the rotationally flexible coupling mechanism (e.g., trackball) through which the retaining ring is coupled to the CMP polishing head. The rotationally flexible coupling mechanism allows the retaining ring to have dynamic rotational movements. Therefore, the retaining ring can be used to polish the bevel region of the wafer by rotating around the wafer and grinding the bevel region of the wafer with its embedded soft material component. The polishing of the bevel region loosens the bevel defects—which may be undesired particles or residue formed on the wafer from previous fabrication processes—so that they may be effectively removed later.

Yet another advantage is offered by the spray nozzle. According to the various aspects of the present disclosure, the spray nozzle is integrated into the CMP polishing head, for example it may be rotatably coupled to the CMP polishing head. Therefore, a cleaning solution can be dispensed on the wafer to wash away the defect particles during the wafer polishing process. In comparison, traditional CMP methods and apparatuses may require a separate cleaning polishing head to be used to clean the wafer surface. Thus, the integration of the spray nozzle herein shortens fabrication time and reduces fabrication costs. Furthermore, the spray nozzle may be coupled to the CMP polishing head through a rotationally flexible coupling mechanism, which allows the spray nozzle to point to a precise desired cleaning area and therefore clean that area effectively.

One of the broader forms of the present disclosure involves a semiconductor fabrication apparatus. The semiconductor fabrication apparatus includes: a polishing head; a retaining structure coupled to the polishing head, wherein the retaining structure is operable to hold a wafer in position; and a component embedded in the retaining structure, wherein the component is softer than the wafer, and wherein the component is operable to make contact with a bevel region of the wafer.

The polishing head includes: a retaining ring that is rotatably coupled to the polishing head, wherein the retaining ring is operable to secure the wafer to be polished; a soft material component located within the retaining ring, wherein the soft material component is softer than silicon, and wherein the soft material component is operable to grind a bevel region of the wafer during the polishing process; and a spray nozzle that is rotatably coupled to the polishing head, wherein the spray nozzle is operable to dispense a cleaning solution to the bevel region of the wafer during the polishing process.

Yet another one of the broader forms of the present disclosure involves a method of fabricating a semiconductor device. The method includes: placing a wafer within a retaining structure, the retaining structure including a component that is softer than the wafer and that is operable to make contact with a bevel region of the wafer; rotating the retaining structure around the bevel region of the wafer in a manner such that the bevel region of the wafer is polished by the component of the retaining structure; dispensing a cleaning solution to the wafer; and polishing a surface of the wafer.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A semiconductor fabrication apparatus, comprising:

a polishing head operable to be rotated, wherein the polishing head includes a membrane configured to polish a front surface or a back surface of a wafer;

a retaining structure coupled to the polishing head through a first rotationally flexible mechanism and a vertically retractable rod, the first rotationally flexible mechanism being coupled between the vertically retractable rod and the retaining structure, wherein a side surface of the retaining structure is separated from the polishing head by an air gap, an upper surface of the retaining structure is separated from the polishing head by the first rotationally flexible mechanism and the vertically retractable rod, wherein a rotational movement of the retaining structure is independent from a rotation of the polishing head, wherein the retaining structure contains a recess that faces a bevel region of the wafer, and wherein the retaining structure allows the bevel region of the wafer to be inserted horizontally into the recess;

a component embedded in the recess of the retaining structure, wherein the component is softer than the wafer and circumferentially surrounds the wafer, and wherein the component is operable to make contact with the bevel region of the wafer once the bevel region is inserted into the recess;

a spray nozzle coupled to the polishing head, the spray nozzle being operable to dispense a cleaning solution; and a second rotationally flexible mechanism coupled between the polishing head and the spray nozzle, wherein the second rotationally flexible mechanism is operable to rotate the spray nozzle in different directions to dispense the cleaning solution to different parts of the bevel region of the wafer wherein the retaining structure is operable to be rotated 360 degrees around the wafer.

2. The semiconductor fabrication apparatus of claim 1, wherein a rotation of the retaining structure is operable to remove bevel defects from the wafer.

3. The semiconductor fabrication apparatus of claim 1, wherein the first rotationally flexible mechanism includes a trackball.

4. The semiconductor fabrication apparatus of claim 1, wherein the semiconductor fabrication apparatus is operable to perform a chemical-mechanical-polishing (CMP) process.

5. The semiconductor fabrication apparatus of claim 1, wherein the retaining structure is configured to hold the wafer in a manner such that at least a portion of the bevel region of the wafer is not inserted into the recess.

6. The semiconductor fabrication apparatus of claim 1, wherein the retaining structure is larger than the wafer in a manner such that a segment of the bevel region of the wafer is separated from the retaining structure by a gap in a top view.

7. A semiconductor fabrication tool, comprising:

a rotatable and movable polishing head that includes a membrane configured to polish a front surface or a back surface of a wafer;

a retaining ring that is rotatably coupled to the polishing head through a first trackball and a vertically retractable rod, the first trackball being coupled between the vertically retractable rod and the retaining ring, wherein the retaining ring is operable to secure a wafer to be polished, and wherein the retaining ring is operable to be rotated independently from the polishing head and is separated from the polishing head by an air gap, the first trackball, and the vertically retractable rod;

a soft material component located within a horizontally-facing recess of the retaining ring, wherein the soft material component includes an angular recess, wherein a bevel region of the wafer is configured to be horizontally inserted into, and make contact with, the soft material component through the angular recess, wherein the angular recess is formed by a side surface and sloped upper and lower surfaces, wherein the soft material component is softer than silicon, and wherein the soft material component is operable to grind the bevel region of the wafer that is in contact therewith during a polishing process; and a spray nozzle that is rotatably coupled to the polishing head through a second trackball, wherein the spray nozzle is operable to dispense a cleaning solution to the bevel region of the wafer during the polishing process.

8. The semiconductor fabrication tool of claim 7, wherein the first trackball and the second trackball each allows for a 360 degree rotational movement.

9. The semiconductor fabrication tool of claim 7, wherein a rotation of the retaining ring around the bevel region of the wafer is carried out separately from a movement of the polishing head with respect to a surface of the wafer.

10. The semiconductor fabrication tool of claim 9, wherein: the retaining ring is operable to loosen undesired particles located on the bevel region by circularly grinding the soft material component around the bevel region; and the spray nozzle is operable to remove the loosened undesired particles by rinsing the particles away from the wafer through the cleaning solution.

11. The semiconductor fabrication tool of claim 7, wherein the soft material component circumferentially surrounds the wafer in 360 degrees.

12. The semiconductor fabrication tool of claim 7, wherein the polishing head is operable to perform a chemical-mechanical-polishing (CMP) process.

13. The semiconductor fabrication tool of claim 7, wherein the retaining ring is configured to hold the wafer in a manner such that at least a portion of the bevel region of the wafer is not inserted into the horizontally-facing recess.

14. A semiconductor fabrication apparatus, comprising:

a polishing head component operable to be rotated, wherein the polishing head component includes a membrane configured to polish a front surface or a back surface of a wafer;

a structure coupled to, but is physically separated from, the polishing head component and is operable to be rotated independently from a rotation of the polishing head component, wherein the polishing head component is separated from an upper surface of the structure through a first rotationally flexible mechanism and a vertically retractable rod, the first rotationally flexible mechanism being coupled between the vertically retractable rod and the structure, such that the structure is operable to be moved around a wafer via the first rotationally flexible mechanism and moved up and down vertically via the vertically retractable rod, and wherein an air gap separates a side surface of the structure from the polishing head component;

a component embedded in the structure, wherein the component is softer than the wafer, and wherein the component is operable to make contact with both a top surface and a bottom surface of a bevel region of the wafer by allowing the wafer to be partially inserted laterally into a recess in the component;

a spray nozzle coupled to the polishing head component and positioned adjacent to the bevel region of the wafer, the spray nozzle being operable to dispense a cleaning solution such that the cleaning solution rinses bevel defects off the bevel region of the wafer; and a second rotationally flexible mechanism coupling the spray nozzle to the polishing head component, wherein the second rotationally flexible mechanism is operable to rotate the spray nozzle in a plurality of different directions, including a direction facing the bevel region of the wafer and a direction facing an upper surface of the wafer.

15. The semiconductor fabrication apparatus of claim 14, wherein a rotation of the structure loosens the bevel defects from the wafer.

16. The semiconductor fabrication apparatus of claim 14, wherein the first rotationally flexible mechanism and the second rotationally flexible mechanism each includes a trackball.

17. The semiconductor fabrication apparatus of claim 14, wherein the structure is configured to hold the wafer in a manner such that at least a portion of the bevel region of the wafer is not inserted into the recess.

18. The semiconductor fabrication apparatus of claim 14, wherein the structure is configured and sized such that while a first bevel region of the wafer is inserted into the recess of the component, a second bevel region of the wafer is spaced apart from the component in a top view, and wherein the first bevel region and the second bevel region collectively define a circumference of the wafer in the top view.

* * * * *